US010704006B2

(12) United States Patent
Barton et al.

(10) Patent No.: US 10,704,006 B2
(45) Date of Patent: Jul. 7, 2020

(54) LUBRICATING COMPOSITION CONTAINING AN ANTIWEAR AGENT

(71) Applicant: The Lubrizol Corporation, Wickliffe, OH (US)

(72) Inventors: William R. S. Barton, Belper (GB); Mark C. Davies, Belper (GB); Michael R. Sutton, Matlock (GB); Matthew D. Gieselman, Wickliffe, OH (US); Christopher L. Friend, Nottingham (GB); Ewan E. Delbridge, Concord Township, OH (US); Patrick E. Mosier, Bay Village, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 16/018,991

(22) Filed: Jun. 26, 2018

(65) Prior Publication Data

US 2018/0305632 A1 Oct. 25, 2018

Related U.S. Application Data

(63) Continuation of application No. 13/994,802, filed as application No. PCT/US2011/065323 on Dec. 16, 2011, now abandoned.

(60) Provisional application No. 61/425,275, filed on Dec. 21, 2010.

(51) Int. Cl.

| | |
|---|---|
| ***C10M 141/10*** | (2006.01) |
| ***B01F 17/00*** | (2006.01) |
| ***C10M 157/00*** | (2006.01) |
| ***C10M 133/16*** | (2006.01) |
| ***C10M 129/36*** | (2006.01) |
| ***C10M 133/04*** | (2006.01) |
| ***C10M 133/08*** | (2006.01) |
| ***C10M 129/76*** | (2006.01) |

(52) U.S. Cl.

CPC ..... *C10M 133/16* (2013.01); *C10M 129/36* (2013.01); *C10M 129/76* (2013.01); *C10M 133/04* (2013.01); *C10M 133/08* (2013.01); *C10M 2207/026* (2013.01); *C10M 2207/028* (2013.01); *C10M 2207/042* (2013.01); *C10M 2207/124* (2013.01); *C10M 2207/262* (2013.01); *C10M 2207/281* (2013.01); *C10M 2207/283* (2013.01); *C10M 2207/289* (2013.01); *C10M 2215/04* (2013.01); *C10M 2215/042* (2013.01); *C10M 2215/064* (2013.01); *C10M 2215/08* (2013.01); *C10M 2215/086* (2013.01); *C10M 2215/224* (2013.01); *C10M 2215/28* (2013.01); *C10M 2219/046* (2013.01); *C10M 2219/089* (2013.01); *C10M 2223/043* (2013.01); *C10M 2223/045* (2013.01); *C10M 2223/06* (2013.01); *C10N 2230/42* (2013.01); *C10N 2230/43* (2013.01); *C10N 2230/45* (2013.01); *C10N 2240/04* (2013.01); *C10N 2240/042* (2013.01); *C10N 2240/044* (2013.01); *C10N 2240/045* (2013.01); *C10N 2240/10* (2013.01); *C10N 2240/101* (2013.01); *C10N 2240/102* (2013.01); *C10N 2240/103* (2013.01); *C10N 2240/104* (2013.01); *C10N 2240/105* (2013.01)

(58) Field of Classification Search

CPC . C10M 129/26; C10M 129/42; C10M 129/34
USPC ..... 508/378, 320, 473
See application file for complete search history.

(56) References Cited

U.S. PATENT DOCUMENTS

| | | | | |
|---|---|---|---|---|
| 2,365,291 | A | 12/1944 | Prutton et al. | |
| 2,443,578 | A | 6/1948 | Fuller et al. | |
| 2,568,472 | A | 9/1951 | Trautman et al. | |
| 2,758,086 | A | 8/1956 | Lowe | |
| 4,211,534 | A * | 7/1980 | Feldman | C10L 1/146 44/394 |
| 4,237,022 | A | 12/1980 | Barrer | |
| 4,478,604 | A | 10/1984 | Schuettenberg | |
| 4,640,787 | A | 2/1987 | Schuettenberg | |
| 4,692,257 | A | 9/1987 | Horodysky | |
| 4,956,110 | A | 9/1990 | Lenack et al. | |
| 4,957,641 | A | 9/1990 | Borggrefe et al. | |
| 5,330,666 | A | 7/1994 | Habeeb | |
| 5,338,470 | A | 8/1994 | Herbert et al. | |
| 5,387,351 | A | 2/1995 | Kumar et al. | |
| 6,008,169 | A | 12/1999 | Kaneko | |
| 6,174,842 | B1 * | 1/2001 | Gatto | C10M 163/00 508/364 |
| 6,508,848 | B1 * | 1/2003 | Peiffer | C08G 81/021 44/393 |
| 2002/0193263 | A1 | 12/2002 | Yoneta et al. | |
| 2005/0019889 | A1 | 9/2005 | Midgal et al. | |
| 2006/0073993 | A1 * | 4/2006 | Culley | C10L 1/1881 508/519 |
| 2008/0234153 | A1 * | 9/2008 | Matsui | C10M 169/04 508/329 |

FOREIGN PATENT DOCUMENTS

| | | |
|---|---|---|
| CA | 1183125 | 2/1985 |
| DE | 2223713 | 6/1973 |
| EP | 0802254 | 10/1997 |
| GB | 2105743 | 3/1983 |
| JP | 60-001291 | 1/1995 |
| WO | 2005/087904 | 9/2005 |
| WO | 2008/147700 | 12/2008 |

(Continued)

*Primary Examiner* — Prem C Singh
*Assistant Examiner* — Francis C Campanell
(74) *Attorney, Agent, or Firm* — Christopher P. Demas; Teresan W. Gilbert

(57) ABSTRACT

The invention provides a lubricating composition containing an antiwear agent and an oil of lubricating viscosity. The invention further relates to the use of the lubricating composition in an internal combustion engine, or a driveline device.

17 Claims, No Drawings

(56) References Cited

FOREIGN PATENT DOCUMENTS

| | | |
|---|---|---|
| WO | 2008/147701 | 12/2008 |
| WO | 2008/147704 | 12/2008 |
| WO | 2010/096167 | 8/2010 |
| WO | 2010/096168 | 8/2010 |
| WO | 2010/096169 | 8/2010 |

* cited by examiner

LUBRICATING COMPOSITION CONTAINING AN ANTIWEAR AGENT

FIELD OF INVENTION

The invention provides a lubricating composition containing an antiwear agent and an oil of lubricating viscosity. The invention further relates to the use of the lubricating composition in an internal combustion engine, or a driveline device.

BACKGROUND OF THE INVENTION

It is well known for lubricating oils to contain a number of surface active additives (including antiwear agents, dispersants, or detergents) used to protect internal combustion engines from corrosion, wear, soot deposits and acid build up. Often, such surface active additives can have harmful effects on engine component wear (in both iron and aluminium based components), bearing corrosion or fuel economy. A common antiwear additive for engine lubricating oils is zinc dialkyldithiophosphate (ZDDP). It is believed that ZDDP antiwear additives protect the engine by forming a protective film on metal surfaces. ZDDP may also have a detrimental impact on fuel economy and efficiency and lead and copper corrosion. Consequently, engine lubricants may also contain a friction modifier to obviate the detrimental impact of ZDDP on fuel economy and corrosion inhibitors to obviate the detrimental impact of ZDDP on lead and copper corrosion. Other additives may also increase lead corrosion.

Further, engine lubricants containing phosphorus compounds and sulphur have been shown to contribute in part to particulate emissions and emissions of other pollutants. In addition, sulphur and phosphorus tend to poison the catalysts used in catalytic converters, resulting in a reduction in performance of said catalysts.

With increasing control of both the formation of sulphated ash and release of emissions (typically to reduce NOx formation, SOx formation) there is a desire towards reduced amounts of sulphur, phosphorus and sulphated ash in engine oils. Consequently, the amounts of phosphorus-containing antiwear agents such as ZDDP, overbased detergents such as calcium or magnesium sulphonates and phenates have been reduced. As a consequence, ashless additives such as esters of polyhydric alcohols or hydroxyl containing acids including glycerol monooleate and alkoxylated amines have been contemplated to provide friction performance. However there have been observations that ashless friction modifiers may in some instances increase corrosion of metal, namely, copper or lead. Copper and lead corrosion may be from bearings and other metal engine components derived from alloys using copper or lead. Consequently, there is a need to reduce the amount of corrosion caused by ashless additives. However, reducing the levels of antiwear and other ash-containing additives may result in increasing amounts of wear and/or corrosion (lead and copper).

U.S. Pat. No. 2,568,472 discloses a composition containing oil and an amine salt of an acid compound and a hydroxycarboxylic acid, wherein the carboxylic acid group is separated by no more than two carbon atoms and the amine salt is present from 0.01 percent by weight to the limit of its solubility in oil. For example glycolic acid is reacted with water, boric acid, and cyclohexylamine.

A variety of patent publications such as CA 1 183 125, U.S. Pat. No. 5,387,351, U.S. 2005/0198894, U.S. Pat. Nos. 4,640,787, 4,692,257, 4,478,604, 4,237,022, GB 2 105 743, U.S. Pat. Nos. 2,443,578, 2,365,291, 5,338,470, WO 2005/087904, WO 2008/147700, WO 2008/147704, and WO 2008/144701 disclose different lubricating compositions containing hydroxycarboxylic acid amides, imides and esters as antiwear agents. None of these references disclose amine salts of hydroxycarboxylic acids.

International publications WO 2010/096167, WO 2010/096168, and WO 2010/096169 disclose method of reducing wear or friction, and deposit formation and oxidation respectively. The compositions disclosed in the three international publications include a lubricating composition containing base oil, at least one additive selected from anti-oxidant, dispersant, detergent ort anti-wear agent. None of these references disclose amine salts of hydroxycarboxylic acids.

For driveline power transmitting devices such as gears or transmissions, especially axle fluids and manual transmission fluids (MTFs), there are highly challenging technological problems and solutions for satisfying the multiple and often conflicting lubricating requirements, whilst providing durability and cleanliness. One of the important parameters influencing durability is the effectiveness of phosphorus antiwear or extreme pressure additives at providing devices with appropriate protection under various conditions of load and speed. However, many of the phosphorus antiwear or extreme pressure additives contain sulphur. Due to increasing environmental concerns, the presence of sulphur in antiwear or extreme pressure additives is becoming less desirable. In addition, many of the sulphur-containing antiwear or extreme pressure additives evolve sulphur due to numerous volatile sulphur species being present, resulting in lubricating compositions containing antiwear or extreme pressure additives having an odor and possibly also being detrimental to health and the environment.

A lubricating composition having the correct balance of phosphorus antiwear or extreme pressure additives provides driveline power transmitting devices with prolonged life and efficiency with controlled deposit formation and oxidation stability. However, many of the antiwear or extreme pressure additives employed have limited oxidative stability, form deposits or increase corrosion. In addition, many phosphorus antiwear or extreme pressure additives typically also contain sulphur, which results in a lubricating composition containing the phosphorus antiwear or extreme pressure additives are odorous.

SUMMARY OF THE INVENTION

The inventors of this invention have discovered a lubricating composition that is capable of providing at least one of antiwear performance, friction modification (particularly for enhancing fuel economy), extreme pressure performance, or lead or copper corrosion inhibition. In one embodiment the invention is capable of providing antiwear performance.

Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated.

As used herein reference to the amounts of additives present in the lubricating composition disclosed herein are quoted on an oil free basis, i.e., amount of actives, unless otherwise indicated.

As used herein the expression "Pnictogens" (the term being derived from Greek pnigein, to choke or stifle) includes the elements in column 15 (or Va) of the periodic table, the column headed by nitrogen. The non-metallic pnictogens include nitrogen and phosphorus.

In one embodiment the present invention provides a lubricating composition comprising an oil of lubricating viscosity and a non-metallic cationic pnictogen salt of a hydroxy-carboxylic acid, or mixtures thereof.

In one embodiment the present invention provides a lubricating composition comprising an oil of lubricating viscosity and either (i) an ammonium salt of a hydroxy-carboxylic acid, or (ii) a phosphonium salt of a hydroxy-carboxylic acid, or (iii) mixtures thereof. Typically a cation of the phosphonium salt may be a quaternary cation.

In one embodiment the present invention provides a lubricating composition comprising an oil of lubricating viscosity and an amine or ammonium salt of a hydroxy-carboxylic acid, or mixtures thereof.

In one embodiment the lubricating composition comprises an oil of lubricating viscosity and an amine salt of a hydroxy-carboxylic acid, or mixtures thereof (typically an ammonium salt) of a hydroxy-carboxylic acid, or mixtures thereof. The ammonium salt may be a quaternary ammonium salt.

In one embodiment the non-metallic cationic pnictogen salt of a hydroxy-carboxylic acid may be free of a borate, and in another embodiment the non-metallic cationic pnictogen salt of a hydroxy-carboxylic acid may be substantially free of boron or a halogen group (such as those derived from chlorine or fluorine).

The amine salt of a hydroxy-carboxylic acid may be derivable from a compound with a primary amine, a secondary amine, a tertiary amine, or mixtures thereof. Typically the amine salt may be derived from a secondary or a tertiary amine.

In one embodiment the non-metallic cationic pnictogen salt of a hydroxy-carboxylic acid may be substantially free of water.

In one embodiment the lubricating composition may be substantially free of a liquid fuel (such as gasoline or diesel) other than contaminant amount of liquid fuel that may have entered an internal combustion crankcase.

In one embodiment the lubricating composition may not be an emulsion.

Typically the present invention provides a lubricating composition comprising an oil of lubricating viscosity and an amine salt of a hydroxy-carboxylic acid, or mixtures thereof.

The non-metallic cationic pnictogen salt of a hydroxy-carboxylic acid may be present in the range of 0.01 wt % to 2 wt %, or 0.02 wt % to 1 wt %, or 0.03 wt % to 0.5 wt %, 0.05 wt % to 0.1 wt % of the lubricating composition.

In one embodiment the invention provides a lubricating composition comprising the non-metallic cationic pnictogen salt of a hydroxy-carboxylic acid disclosed herein and a diaryl amine such as an alkylated diphenylamine, or a phenyl-α-naphthylamine (PANA) or an alkylated PANA. The alkylated diphenylamine may include bis-nonylated diphenylamine, nonyl diphenylamine, octyl diphenylamine, bis-octylated diphenylamine, bis-decylated diphenylamine, decyl diphenylamine and mixtures thereof. In one embodiment the diphenylamine may include nonyl, diphenylamine, dinonyl diphenylamine, octyl diphenylamine, dioctyl diphenylamine, or mixtures thereof. In one embodiment the diphenylamine may include nonyl, diphenylamine, or dinonyl diphenylamine. The phenyl-α-naphthylamine may be phenyl-α-naphthylamine itself, or it may be a mono- or di-alkylated with a group such as octyl, di-octyl, nonyl, di-nonyl, decyl or di-decyl.

When present, the alkylated diphenylamine or a phenyl-α-naphthylamine may be present at 0.05 wt % to 5 wt %, or 0.1 wt % to 3 wt %, or 0.5 wt % to 2 wt % of the lubricating composition.

In one embodiment the invention provides a lubricating composition wherein the non-metallic cationic pnictogen salt of a hydroxy-carboxylic acid disclosed herein may be present at 0.01 wt % to 2 wt % (or typically 0.05 wt % to 0.5) wt % and the alkylated diphenylamine or a phenyl-α-naphthylamine may be present at 0.1 wt % to 3 wt % (or typically 0.5 wt % to 2 wt %) of the lubricating composition.

In one embodiment the present invention provides a method of lubricating a mechanical device comprising supplying to the mechanical device a lubricating composition comprising an oil of lubricating viscosity and a non-metallic cationic pnictogen salt of a hydroxy-carboxylic acid as disclosed herein.

In one embodiment the invention provides a method of lubricating an internal combustion engine comprising supplying to the engine a lubricating composition as disclosed herein.

In one embodiment the invention provides a method of lubricating an internal combustion engine as disclosed herein has an aluminium alloy, aluminium composite or steel (i.e., iron-containing) surface on a cylinder bore, cylinder block, or piston ring.

In one embodiment the invention provides a method of lubricating a driveline device comprising supplying to the driveline device a lubricating composition as disclosed herein.

In one embodiment the invention provides for the non-metallic cationic pnictogen salt of a hydroxy-carboxylic acid, or mixtures thereof as disclosed herein as an antiwear agent in a lubricating composition.

In one embodiment the invention provides for the use of the non-metallic cationic pnictogen salt of a hydroxy-carboxylic acid, or mixtures thereof as disclosed herein as an antiwear agent in a lubricating composition for an internal combustion engine, or a driveline device.

DETAILED DESCRIPTION OF THE INVENTION

The present invention provides a lubricating composition and a method for lubricating an internal combustion engine or a driveline device as disclosed herein.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10). In one embodiment the oil of lubricating viscosity may be an API Group II, Group III, Group IV oil, or mixtures thereof.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Hydroxy-Carboxylic Acid

In one embodiment the amine salt or ammonium salt of a hydroxy-carboxylic acid may be derived from reacting a hydroxy-carboxylic acid with an amine or mixtures thereof.

In one embodiment the non-metallic cationic pnictogen salt of a hydroxy-carboxylic acid may be derived from reacting a hydroxy-carboxylic acid with a nitrogen containing compound capable of forming a tertiary or quaternary ammonium salt, or a phosphorus compound capable of forming quaternary phosphonium ions.

The hydroxycarboxylic acid may be a partial acid or a full acid. As used herein "partial acid" is intended to encompass compounds that have ester, amide or imide functionality, with the proviso that at least one acid group of the hydroxycarboxylic acid remains in the acid form. In one embodiment the hydroxycarboxylic acid may be a partial acid, or mixtures thereof. In one embodiment the hydroxycarboxylic acid may be a full acid, or mixtures thereof. The hydroxycarboxylic acid described herein may be represented by the formula:

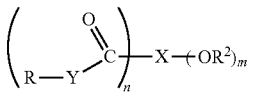

wherein n and m may be independently integers of 1 to 5;

X may be an aliphatic or alicyclic group, or an aliphatic or alicyclic group containing an oxygen atom in the carbon chain, or a substituted group of the foregoing types, said group containing up to 6 carbon atoms and having n+m available points of attachment;

each Y may be independently —O—, >NH, or >$NR^1$ or two Ys together representing the nitrogen of an imide structure R—N<formed between two carbonyl groups; and each R and $R^1$ may be independently hydrogen or a hydrocarbyl group, provided that at least one R or $R^1$ group is a hydrocarbyl group; each $R^2$ may be independently hydrogen, a hydrocarbyl group or an acyl group, further provided that at least one —$OR^2$ group is located on a carbon atom within X that is a or 3 to at least one of the —C(O)—Y—R groups, and with the proviso that at least one $R^2$ of the —$OR^2$ group per molecule is hydrogen, and at least one R of the —Y—R group per molecule is —H (i.e., —Y—R group is —OH).

The hydroxy-carboxylic acid may be derived from glycolic acid (n and m both equal 1), malic acid (n=2, m=1), tartaric acid (n and m both equal 2), citric acid (n=3, m=1), or mixtures thereof. In one embodiment the compound derived from the hydroxy-carboxylic acid may be derived from tartaric acid, citric acid, glycolic acid, or mixtures thereof. In another embodiment the compound derived from the hydroxy-carboxylic acid may be derived from tartaric acid, citric acid, or mixtures thereof. The compound derived from the hydroxy-carboxylic acid may be derived from citric acid, or mixtures thereof. The compound derived from the hydroxy-carboxylic acid may be derived from tartaric acid, or mixtures thereof.

In instances where the hydroxycarboxylic acid has two or more carboxylic acid groups (i.e., a hydroxy-polyacid), a salt may be formed with one or more equivalents of cationic pnictogen (e.g., amine or ammonium). A neutral salt may be considered to be a compound where there is one pnictogenic cation for each carboxylic acid group in the hydroxycarboxylic acid. For example, a neutral salt of tartaric acid may be formed with two equivalents of amine (or ammonium); this is an example of a 2:1 or "bis" salt. In one embodiment, the oil soluble salt of the hydroxy-polyacid may be formed with fewer equivalents of cationic pnictogen than that required to form a neutral salt. For example, a partial salt of tartaric acid may be formed with one equivalent of amine (or ammonium); this is an example of a 1:1 or "mono" salt or an acid-salt. An acid-salt of this type has an equivalent of neutral salt and one (or more) equivalents of free acid. A partial salt of the present invention may be a hydroxycarboxylic acid represented by the formula above, wherein n may be an integer of 2 to 5;

m may be an integer of 1 to 5;

X may be an aliphatic or alicyclic group, or an aliphatic or alicyclic group containing an oxygen atom in the carbon chain, or a substituted group of the foregoing types, said group containing up to 6 carbon atoms and having n+m available points of attachment;

each Y may be independently —O—, >NH, or >$NR^1$ or two Ys together representing the nitrogen of an imide structure R—N<formed between two carbonyl groups; and each R and $R^1$ may be independently hydrogen or a hydrocarbyl group, with the proviso that at least one R or $R^1$ group is a hydrocarbyl group;

each $R^2$ may be independently hydrogen, a hydrocarbyl group or an acyl group, with the proviso that at least one —$OR^2$ group is located on a carbon atom within X that is α or β to at least one of the —C(O)—Y—R groups, and with the proviso that at least $R^2$ of the —$OR^2$ group per molecule is —H, and at least one R of the —Y—R group per molecule is —H.

Amine

The amine may include a mono- or di- or polyamine, with the proviso that there is at least one primary, secondary, or tertiary amino group. The amine forms a cation, typically an ammonium ion, i.e., a protonated amine or quaternary ammonium ion.

The amine may be a linear or branched acyclic amine, a cyclic amine (aromatic or non-aromatic), or mixtures thereof.

The amine may be an alkyl amine, typically a di- or tri-alkyl amine. The alkyl amine may have alkyl groups having 1 to 30, or 2 to 20, or 3 to 10 carbon atoms. Examples of a dialkyl amine include diethylamine, dipropylamine, dibutylamine, dipentylamine, dihexylamine, di-(2-ethylhexyl)amine, di-decylamine, di-dodecylamine, di-stearylamine, di-oleylamine, di-eicosylamine, or mixtures thereof. Examples of a trialkyl amine include triethylamine, tripropylamine, tributylamine, tripentylamine, trihexylamine, tri-(2-ethylhexyl)amine, tri-decylamine, tri-dodecylamine, tri-stearylamine, tri-oleylamine, tri-eicosylamine, or mixtures thereof.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the phosphorus acid amine salt includes an amine with C11 to C14 tertiary alkyl primary groups or mixtures thereof. In one embodiment the amine salt includes an amine with C14 to C18 tertiary alkyl primary amines or mixtures thereof. In one embodiment the phosphorus acid amine salt includes an amine with C18 to C22 tertiary alkyl primary amines or mixtures thereof.

Mixtures of amines may also be used. In one embodiment a useful mixture of amines include "Primene® 81R" and "Primene® JMT." Primene® 81R and Primene® JMT (both produced and sold by Rohm & Haas, or Dow Chemicals) are mixtures of C11 to C14 tertiary alkyl primary amines and C18 to C22 tertiary alkyl primary amines respectively.

In one embodiment the amine salt may be in the form of a quaternary ammonium salt. Examples of quaternary ammonium salts containing a hydroxyalkyl group, and methods for their synthesis, are disclosed in U.S. Pat. No. 3,962,104, see column 1 line 16 through column 2 line 49; column 8 lines 13 through 49, and the Examples. In certain embodiments, the quaternary ammonium compound is derived from a monoamine by means of alkylation, i.e., from a tertiary amine having only a single amino group, that is, having no additional amine nitrogen atoms in any of the three hydrocarbyl groups or substituted hydrocarbyl groups attached to the tertiary amine nitrogen. In certain embodiments there are no additional amine nitrogen atoms in any of the hydrocarbyl groups or substituted hydrocarbyl groups attached to the central nitrogen in the quaternary ammonium ion. The tetraalkylammonium hydroxide may contain alkyl groups having 1 to 30, or 2 to 20, or 3 to 10 carbon atoms. The tetraalkylammonium hydroxide may include tetrapropylammonium hydroxide, tetrabutylammonium hydroxide, tetrapentylammonium hydroxide, tetrahexylammonium hydroxide, tetra-2-ethylhexylammonium hydroxide, or tetradecylammonium hydroxide, or mixtures thereof.

The amine may be a polyamine in the "Duomeen" series, available from Akzo Nobel. The polyamine may be prepared by the addition a monoamine $R^3R^4NH$ to acrylonitrile, wherein $R^3$ and $R^4$ may be hydrogen or a hydrocarbyl group (such as a linear, branched or cyclic hydrocarbyl group containing 1 to 30, or 8 to 20 carbon atoms (typically the hydrocarbyl group may be linear or branched), followed by catalytic reduction of the resulting nitrile compound, using, e.g., $H_2$ over Pd/C catalyst, to give the diamine. The Duomeen amine may have a general structure of

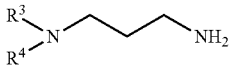

wherein $R^3$ and $R^4$ are described previously.

The amine may be a compound typically having a tertiary amino group. Amines with a tertiary amino group include b1-aminopiperidine, 1-(2-aminoethyl)piperidine, 1-(3-aminopropyl)-2-pipecoline, 1-methyl-(4-methyl-amino)piperidine, 4-(1-pyrrolidinyl)piperidine, 1-(2-aminoethyl)pyrrolidine, 2-(2-aminoethyl)-1-methylpyrrolidine, N,N-diethyl ethylenediamine, N,N-dimethylethylenediamine, N,N-dibutylethylenediamine, N,N-diethyl-1,3-diaminopropane, N,N-dimethyl-1,3-diaminopropane, N,N,N'-trimethylethylene-di amine, N,N-dimethyl-N'-ethylethylenediamine, N,N-di ethyl-N'-methyl-ethylenediamine, N,N,N'-triethylethylenediamine, 3-dimethyl aminopropylamine, 3-di ethylamino-propyl amine, 3-dibutylaminopropylamine, N,N,N'-trimethyl-1,3-propanediamine, N,N,2,2-tetramethyl-1,3-propanediamine, 2-amino-5-diethyl-aminopentane, N,N,N',N'-tetraethyl di ethylenetriamine, 3,3'-diamino-N-methyldipropylamine, 3,3'-iminobis(N,N-dimethylpropylamine), or mixtures thereof.

In some embodiments the amine may be N,N-dimethyl-1,3-diaminopropane, N,N-diethyl-1,3-diaminopropane, N,N-dimethylethylenediamine, N,N-diethylethylenediamine, N,N-dibutylethylenediamine, or mixtures thereof.

In one embodiment, the amine may be a dispersant containing amine functionality. Such dispersants include succinimide dispersants, described in greater detail hereinbelow.

The amine may be quaternised with a quaternising agent, or mixtures thereof.

The nitrogen or oxygen containing compounds may further include aminoalkyl substituted heterocyclic compounds such as 1-(3-amino-propyl)imidazole and 4-(3-aminopropyl)morpholine, 1-(2-aminoethyl)piperidine, 3,3-diamino-N-methyldipropylamine, or 3,3-aminobis(N,N-dimethylpropylamine).

Other examples of quaternary ammonium salt and methods for preparing the same are described in the following patents, which are hereby incorporated by reference, U.S. Pat. Nos. 4,253,980, 3,778,371, 4,171,959, 4,326,973, 4,338,206, and 5,254,138.

When the amine salt is derived from an aromatic amine, the aromatic amine may form an ion such as a pyridinium ion, or an imidazolium ion.

Certain quaternary phosphonium salts may be prepared by the reaction of phosphine with aldehydes and a halide e.g., tetrakis(hydroxy-methyl)phosphonium halide (typically chloride).

A quaternary pnictogen halide compound may be a commercially available material, or it may be prepared by reaction of a tertiary amine with a hydrocarbyl halide, by known techniques. This reaction may be done in a separate vessel or in the same vessel in which it is subsequently (or simultaneously) reacted with the oil-soluble acidic compound, which may be converted previously (or simultaneously) into its metal neutralized form.

The non-metallic cationic pnictogen salt of a hydroxy-carboxylic acid of the present invention may be prepared by a number of processes. The processes include:

(i) reacting a metal salt (such as sodium, lithium, potassium, typically sodium) of hydroxy-carboxylic acid with an ammonium halide (typically a chloride);

(ii) reacting a hydroxy-carboxylic acid with an ammonium hydroxide;

(iii) reacting a hydroxyl-carboxylic acid directly with an amine.

The reaction temperature may range from ambient (approximately 23° C.) to 150° C., or 40° C. to 120° C.

The reaction may be prepared in the presence or absence of solvent. The solvent may include toluene, xylenes, methanol, ethanol, water, or diluent oil.

Salts of primary, secondary or tertiary amines with carboxylic acids will have both basic and acidic character; this character is measured as total base number (TBN) and total acid number (TAN). Neutral salts of quaternary ammonium (i.e. tetraalkylammonium) and carboxylic acids typically have TBN but very little measurable TAN (typically less than 5 mg KOH/g, or less than 1 mg KOH/g, or about 0 mg KOH/g). The non-metallic cationic pnictogen salt of a hydroxy-carboxylic acid of the present invention may have a total base number (TBN) of at least 40 mg KOH/g, or at least 80 mg KOH/g, or even at least 100 mg KOH/g. In one embodiment the salt of the invention has a TBN of 40 to 200 mg KOH/g. The salt of the invention may have a TAN of less than 200 mg KOH/g, or less than 140 mg KOH/g, or even less than 20 mg KOH/g. In one embodiment the salt of the invention has a TAN of 0 to 15 mg KOH/g.

A lubricating composition may be prepared by adding the product of the process described herein to an oil of lubricating viscosity, optionally in the presence of other performance additives (as described herein below).

Other Performance Additives

A lubricating composition may be prepared by adding the product of the process described herein to an oil of lubricating viscosity, optionally in the presence of other performance additives (as described herein below).

The lubricating composition of the invention optionally comprises other performance additives. The other performance additives include at least one of metal deactivators, viscosity modifiers, detergents, friction modifiers, antiwear agents, corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

Antioxidants include sulphurised olefins, diarylamines, alkylated diarylamines, hindered phenols, molybdenum compounds (such as molybdenum dithiocarbamates), hydroxyl thioethers, or mixtures thereof. In one embodiment the lubricating composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the lubricating composition.

The diarylamine or alkylated diarylamine may be phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of molybdenum dithiocarbamates which may be used as an antioxidant include commercial materials sold under the trade names such as Vanlube 822™ and Molyvan™ A from R. T. Vanderbilt Co., Ltd., and Adeka Sakura-Lube™ S-100, S-165, S-600 and 525, or mixtures thereof.

In one embodiment the lubricating composition further includes a viscosity modifier. The viscosity modifier is known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment the lubricating composition of the invention further comprises a dispersant viscosity modifier. The dispersant viscosity modifier may be present at 0 wt % to 15 wt %, or 0 wt % to 10 wt %, or 0.05 wt % to 5 wt %, or 0.2 wt % to 2 wt % of the lubricating composition.

The lubricating composition may further include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, di ethylenetriamine, triethyl enetetramine, tetraethyl enepentamine, pentaethylenehexamine, polyamine still bottoms, and mixtures thereof.

The succinimide dispersant may be derived from an aromatic amine, aromatic polyamine, or mixtures thereof. The aromatic amine may have one or more aromatic moieties linked by a hydrocarbylene group and/or a heteroatom. In certain embodiments, the aromatic amine may be a nitro-substituted aromatic amine. Examples of nitro-substituted aromatic amines include 2-nitroaniline, 3-nitroaniline, and 4-nitroaniline (typically 3-nitroaniline). Other aromatic amines may be present along with the nitroaniline described herein. Condensation products with nitroaniline and optionally also with Disperse Orange 3 (that is, 4-(4-nitrophenylazo)aniline) are known from US Patent Application 2006/0025316.

The succinimide dispersant may be derived from 4-aminodiphenylamine, or mixtures thereof. A succinimide dispersant derived from 4-aminodiphenylamine include those disclosed in International Patent Applications WO2010/062842 or WO2010/099136.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and an amine (such as a diamine, typically diethyleneamine).

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant may be reacted with dimercaptothiadiazoles. In one embodiment the post-treated dispersant may be reacted with phosphoric or phosphorous acid.

The dispersant may be present at 0.01 wt % to 20 wt %, or 0.1 wt % to 15 wt %, or 0.1 wt % to 10 wt %, or 1 wt % to 6 wt %, or 1 to 3 wt % of the lubricating composition.

In one embodiment the invention provides a lubricating composition further comprising an overbased metal-containing detergent. The metal of the metal-containing detergent may be zinc, sodium, calcium, barium, or magnesium. Typically the metal of the metal-containing detergent may be sodium, calcium, or magnesium.

The overbased metal-containing detergent may be selected from the group consisting of non-sulphur containing phenates, sulphur containing phenates, sulphonates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulphonate components, e.g. phenate/salicylates, sulphonate/phenates, sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent may be employed, the hybrid detergent would be considered equivalent to amounts of distinct phenate and sulphonate detergents introducing like amounts of phenate and sulphonate soaps, respectively.

Typically an overbased metal-containing detergent may be a zinc, sodium, calcium or magnesium salt of a phenate, sulphur containing phenate, sulphonate, salixarate or salicylate. Overbased salixarates, phenates and salicylates typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). The predominantly linear alkylbenzene sulphonate detergent may be particularly useful for assisting in improving fuel economy.

Typically the overbased metal-containing detergent may be a calcium or magnesium overbased detergent.

Overbased detergents are known in the art. Overbased materials, otherwise referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The term "metal ratio is also explained in standard textbook entitled "Chemistry and Technology of Lubricants", Second Edition, Edited by R. M. Mortier and S. T. Orszulik, Copyright 1997.

In one embodiment the friction modifier may be selected from the group consisting of long chain fatty acid derivatives of amines, long chain fatty esters, or derivatives of a long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22, or 12 to 20 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines;

hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulphurised fatty compounds and olefins, molybdenum dialkyldithiophosphates, molybdenum dithiocarbamates, sunflower oil or soybean oil monoester of a polyol and an aliphatic carboxylic acid.

In one embodiment the friction modifier may be a long chain fatty acid ester. In another embodiment the long chain fatty acid ester may be a mono-ester and in another embodiment the long chain fatty acid ester may be a (tri)glyceride.

The lubricating composition optionally further includes at least one antiwear agent. Examples of suitable antiwear agents include titanium compounds, tartrates, tartrimides, oil soluble amine salts of phosphorus compounds, sulphurised olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis (S-alkyldithiocarbamyl) disulphides. The antiwear agent may in one embodiment include a tartrate, or tartrimide as disclosed in International Publication WO 2006/044411 or Canadian Patent CA 1 183 125. The tartrate or tartrimide may contain alkyl-ester groups, where the sum of carbon atoms on the alkyl groups may be at least 8. The antiwear agent may in one embodiment include a citrate as is disclosed in US Patent Application 20050198894.

Another class of anti-wear additives includes oil-soluble titanium compounds as disclosed in U.S. Pat. No. 7,727,943 and US20060014651. The oil-soluble titanium compounds may function as antiwear agents, friction modifiers, antioxidants, deposit control additives, or more than one of these functions. In one embodiment the oil soluble titanium compound may be a titanium (IV) alkoxide. The titanium alkoxide may be formed from a monohydric alcohol, a polyol or mixtures thereof. The monohydric alkoxides may have 2 to 16, or 3 to 10 carbon atoms. In one embodiment, the titanium alkoxide may be titanium (IV) isopropoxide. In one embodiment, the titanium alkoxide may be titanium (IV) 2-ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid may be oleic acid.

In one embodiment, the oil soluble titanium compound may be a titanium carboxylate. In one embodiment the titanium (IV) carboxylate may be titanium neodecanoate.

In one embodiment the oil soluble titanium compound may be present in the lubricating composition in an amount necessary to provide for 10 ppm to 1500 ppm titanium by weight or 25 ppm to 150 ppm titanium by weight.

Extreme Pressure (EP) agents that are soluble in the oil include sulphur- and chlorosulphur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulphurised olefins (such as sulphurised isobutylene), a hydrocarbyl-substituted 2,5-dimercapto-1,3,4-thiadiazole, or oligomers thereof, organic sulphides and polysulphides such as dibenzyl-disulphide, bis-(chlorobenzyl) disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclo-hexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptyl-phenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Foam inhibitors that may be useful in the compositions of the invention include polysiloxanes, copolymers of ethyl acrylate, and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulfolene derivatives Exxon Necton-37™ (FN 1380) and Exxon Mineral Seal Oil™ (FN 3200).

Industrial Application

The lubricating composition of the present invention may be useful in an internal combustion engine, a driveline device, a hydraulic system, a grease, a turbine, or a refrigerant. If the lubricating composition is part of a grease composition, the composition further comprises a thickener. The thickener may include simple metal soap thickeners, soap complexes, non-soap thickeners, metal salts of such acid-functionalized oils, polyurea and diurea thickeners, calcium sulphonate thickeners or mixtures thereof. Thickeners for grease are well known in the art.

In one embodiment the invention provides a method of lubricating an internal combustion engine. The engine components may have a surface of steel or aluminium.

An aluminium surface may be derived from an aluminium alloy that may be a eutectic or a hyper-eutectic aluminium alloy (such as those derived from aluminium silicates, aluminium oxides, or other ceramic materials). The aluminium surface may be present on a cylinder bore, cylinder block, or piston ring having an aluminium alloy, or aluminium composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine, a mixed gasoline/alcohol fuelled engine, or a hydrogen fuelled internal combustion engine. In one embodiment the internal combustion engine may be a diesel fuelled engine and in another embodiment a gasoline fuelled engine. In one embodiment the internal combustion engine may be a heavy duty diesel engine.

The internal combustion engine may be a 2-stroke or 4-stroke engine. Suitable internal combustion engines include marine diesel engines, aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine).

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt % to 0.12 wt %. In one embodiment the phosphorus content may be 100 ppm to 1000 ppm, or 200 ppm to 600 ppm. In one embodiment the zinc content may be 0.2 wt % or less, or 0.13 wt % or less, or 0.1 wt % or less, or even 0.05% or less. In one embodiment the zinc content may be 0.01 wt % to 0.2 wt %. In one embodiment, the composition may be free of zinc. The total sulphated ash content may be 0.3 wt % to 1.2 wt %, or 0.5 wt % to 1.1 wt % of the lubricating composition. In one embodiment the sulphated ash content may be 0.5 wt % to 1.1 wt % of the lubricating composition.

In one embodiment the lubricating composition may be an engine oil, wherein the lubricating composition may be characterised as having at least one of (i) a sulphur content of 0.5 wt % or less, (ii) a phosphorus content of 0.12 wt % or less, and (iii) a sulphated ash content of 0.5 wt % to 1.1 wt % of the lubricating composition.

An engine lubricating composition may further include other additives. In one embodiment the invention provides a lubricating composition further comprising at least one of a dispersant, an antiwear agent, a dispersant viscosity modifier (other than the compound of the invention), a friction modifier, a viscosity modifier, an antioxidant, an overbased detergent, or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), or mixtures thereof.

In one embodiment an engine lubricating composition may be a lubricating composition further comprising a molybdenum compound. The molybdenum compound may be an antiwear agent or an antioxidant. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

An engine lubricating composition may further include a phosphorus-containing antiwear agent. Typically the phosphorus-containing antiwear agent may be a zinc dialkyldithiophosphate, phosphite, phosphate, phosphonate, and ammonium phosphate salts, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

The overbased detergent may be present at 0 wt % to 15 wt %, or 0.1 wt % to 10 wt %, or 0.2 wt % to 8 wt %, or 0.2 wt % to 3 wt %. For example in a heavy duty diesel engine the detergent may be present at 2 wt % to 3 wt % of the lubricating composition. For a passenger car engine the detergent may be present at 0.2 wt % to 1 wt % of the lubricating composition. In one embodiment, an engine lubricating composition further comprises at least one overbased detergent with a metal ratio of at least 3, or at least 8, or at least 15.

Useful corrosion inhibitors for an engine lubricating composition include those described in paragraphs 5 to 8 of WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt %, or 0.2 wt % to 1.2 wt % of the lubricating composition.

An engine lubricating composition in different embodiments may have a composition as disclosed in the following table:

| | Embodiments (wt %) | | |
|---|---|---|---|
| Additive | A | B | C |
| Product of Invention | 0.02 to 1 | 0.03 to 0.5 | 0.05 to 0.1 |
| Dispersant | 0 to 12 | 0 to 8 | 0.5 to 6 |
| Dispersant Viscosity Modifier | 0 to 5 | 0 to 4 | 0.05 to 2 |
| Overbased Detergent | 0.1 to 15 | 0.1 to 10 | 0.2 to 8 |
| Antioxidant | 0.1 to 13 | 0.1 to 10 | 0.5 to 5 |
| Antiwear Agent | 0.1 to 15 | 0.1 to 10 | 0.3 to 5 |
| Friction Modifier | 0.01 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

Driveline Device

In one embodiment the method and lubricating composition of the invention may be suitable for a driveline device. The driveline device includes at least one of gear oils, axle oils, drive shaft oils, traction oils, manual transmission oils, automatic transmission oils, or off highway oils (such as a farm tractor oil). In one embodiment the invention provides a method of lubricating a manual transmission that may or may not contain a synchronizer system. In one embodiment the invention provides a method of lubricating an automatic transmission. In one embodiment the invention provides a method of lubricating an axle.

A lubricating composition for a driveline device may have a sulphur-content of greater than 0.05 wt %, or 0.4 wt % to 5 wt %, or 0.5 wt % to 3 wt %, 0.8 wt % to 2.5 wt %, 1 wt % to 2 wt %, 0.075 wt % to 0.5 wt %, or 0.1 wt % to 0.25 wt % of the lubricating composition.

A lubricating composition for a driveline device may have a phosphorus content of 100 ppm to 5000 ppm, or 200 ppm to 4750 ppm, 300 ppm to 4500 ppm, or 450 ppm to 4000 ppm.

An automatic transmission includes continuously variable transmissions (CVT), infinitely variable transmissions (IVT), toroidal transmissions, continuously slipping torque converter clutches (CSTCC), stepped automatic transmissions or dual clutch transmissions (DCT).

Automatic transmissions can contain continuously slipping torque converter clutches (CSTCC), wet start and shifting clutches and in some cases may also include metal or composite synchronizers.

Dual clutch transmissions or automatic transmissions may also incorporate electric motor units to provide a hybrid drive.

A manual transmission lubricant may be used in a manual gearbox which may be unsynchronized or may contain a synchronizer mechanism. The gearbox may be self-contained or may additionally contain any of a transfer gearbox, planetary gear system, differential, limited slip differential or torque vectoring device, which may be lubricated by a manual transmission fluid.

The gear oil or axle oil may be used in planetary hub reduction axles, mechanical steering and transfer gear boxes in utility vehicles, synchromesh gear boxes, power take-off gears, limited slip axles, and planetary hub reduction gear boxes.

If the lubricating composition of the invention is suitable for a driveline device, a succinimide dispersant as generally described previously may be used. In one embodiment the succinimide dispersant may be an N-substituted long chain alkenyl succinimide. The long chain alkenyl succinimide may include polyisobutylene succinimide, wherein the polyisobutylene from which it is derived has a number average molecular weight in the range 350 to 5000, or 500 to 3000, or 750 to 1150.

In one embodiment the dispersant for a driveline device may be a post treated dispersant. The dispersant may be post treated with dimercaptothiadiazole, optionally in the presence of one or more of a phosphorus compound, a dicarboxylic acid of an aromatic compound, and a borating agent.

In one embodiment the post treated dispersant may be formed by heating an alkenyl succinimide or succinimide detergent with a phosphorus ester and water to partially hydrolyze the ester. The post treated dispersant of this type is disclosed for example in U.S. Pat. No. 5,164,103.

In one embodiment the post treated dispersant may be produced by preparing a mixture of a dispersant and a dimercaptothiadiazole and heating the mixture above about 100° C. The post treated dispersant of this type is disclosed, for example, in U.S. Pat. No. 4,136,043.

In one embodiment the dispersant may be post treated to form a product prepared comprising heating together: (i) a dispersant (typically a succinimide), (ii) 2,5-dimercapto-1,3,4-thiadiazole or a hydrocarbyl-substituted 2,5-dimercapto-1,3,4-thiadiazole, or oligomers thereof, (iii) a borating agent (similar to those described above); and (iv) optionally a dicarboxylic acid of an aromatic compound selected from the group consisting of 1,3 diacids and 1,4 diacids (typically terephthalic acid), or (v) optionally a phosphorus acid compound (including either phosphoric acid or phosphorous acid), said heating being sufficient to provide a product of (i), (ii), (iii) and optionally (iv) or optionally (v), which is soluble in an oil of lubricating viscosity. The post treated dispersant of this type is disclosed for example in International Application WO 2006/654726 A.

Examples of a suitable dimercaptothiadiazole include 2,5-dimercapto-1,3,4-thiadiazole or a hydrocarbyl-substituted 2,5-dimercapto-1,3,4-thiadiazole. In several embodiments the number of carbon atoms on the hydrocarbyl-substituent group includes 1 to 30, 2 to 25, 4 to 20, or 6 to 16. Examples of suitable 2,5-bis(alkyl-dithio)-1,3,4-thiadiazoles include 2,5-bis(tert-octyldithio)-1,3,4-thiadiazole 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-pentadecyldithio)-1,3,4-thiadiazole, 2,5-bis(tert-hexadecyldithio)-1,3,4-thiadiazole, 2,5-bis(tert-heptadecyldithio)-1,3,4-thiadiazole, 2,5-bis(tert-octadecyldithio)-1,3,4-thiadiazole, 2,5-bis(tert-nonadecyldithio)-1,3,4-thiadiazole or 2,5-bis(tert-eicosyldithio)-1,3,4-thiadiazole, or oligomers thereof.

In one embodiment the oil soluble phosphorus amine salt antiwear agent includes an amine salt of a phosphorus acid ester or mixtures thereof. The amine salt of a phosphorus acid ester includes phosphoric acid esters and amine salts thereof; dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. The amine salt of a phosphorus acid ester may be used alone or in combination.

In one embodiment the oil soluble phosphorus amine salt includes partial amine salt-partial metal salt compounds or mixtures thereof. In one embodiment the phosphorus compound further includes a sulphur atom in the molecule.

Examples of the antiwear agent may include a non-ionic phosphorus compound (typically compounds having phosphorus atoms with an oxidation state of +3 or +5). In one embodiment the amine salt of the phosphorus compound may be ashless, i.e., metal-free (prior to being mixed with other components).

The amines which may be suitable for use as the amine salt of the phosphorus compound include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include bis-2-ethylhexyl amine, dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the phosphorus acid amine salt includes an amine with C11 to C14 tertiary alkyl primary groups or mixtures thereof. In one embodiment the phosphorus acid amine salt includes an amine with C14 to C18 tertiary alkyl primary amines or mixtures thereof. In one embodiment the phosphorus acid amine salt includes an amine with C18 to C22 tertiary alkyl primary amines or mixtures thereof.

Mixtures of amines may also be used in this optional antiwear agent. In one embodiment a useful mixture of amines include "Primene® 81R" and "Primene® JMT." Primene® 81R and Primene® JMT (both produced and sold by Rohm & Haas, or Dow Chemicals) are mixtures of C11 to C14 tertiary alkyl primary amines and C18 to C22 tertiary alkyl primary amines respectively.

In one embodiment oil soluble amine salts of phosphorus compounds include a sulphur-free amine salt of a phosphorus-containing compound may be obtained/obtainable by a process comprising: reacting an amine with either (i) a hydroxy-substituted di-ester of phosphoric acid, or (ii) a phosphorylated hydroxy-substituted di- or tri-ester of phosphoric acid. A more detailed description of compounds of this type is disclosed in International Application PCT/US08/051126 (or equivalent to U.S. application Ser. No. 11/627,405).

In one embodiment the hydrocarbyl amine salt of an alkylphosphoric acid ester is the reaction product of a C14 to C18 alkyl phosphoric acid with Primene 81R™ (produced and sold by Rohm & Haas, or Dow Chemicals) which is a mixture of C11 to C14 tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, and styrene oxide. In one embodiment the epoxide may be propylene oxide. The glycols may be aliphatic glycols having from 1 to 12, or from 2 to 6, or 2 to 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grams) at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture may be heated at 75° C. for 2.5 hours, mixed with a diatomaceous earth and filtered at 70° C. The filtrate contains 11.8% by weight phosphorus, 15.2% by weight sulphur, and an acid number of 87 (bromophenol blue).

The dithiocarbamate-containing compounds may be prepared by reacting a dithiocarbamate acid or salt with an unsaturated compound. The dithiocarbamate containing compounds may also be prepared by simultaneously reacting an amine, carbon disulphide and an unsaturated compound. Generally, the reaction occurs at a temperature from 25° C. to 125° C.

Examples of suitable olefins that may be sulphurised to form a sulphurised olefin include propylene, butylene, isobutylene, pentene, hexane, heptene, octane, nonene, decene, undecene, dodecene, undecyl, tridecene, tetradecene, pentadecene, hexadecene, heptadecene, octadecene, octadecenene, nonodecene, eicosene or mixtures thereof. In one embodiment, hexadecene, heptadecene, octadecene, octadecenene, nonodecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulphurised olefin includes fatty acids and their esters. The fatty acids are often obtained from vegetable oil or animal oil; and typically contain 4 to 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins.

Corrosion inhibitors useful for a driveline device include 1-amino-2-propanol, amines, triazole derivatives including tolyl triazole, dimercaptothiadiazole derivatives, octylamine octanoate, condensation products of dodecenyl succinic acid or anhydride and/or a fatty acid such as oleic acid with a polyamine.

A driveline device lubricating composition may contain an overbased detergent that may or may not be borated. For example, the lubricating composition may contain a borated overbased calcium or magnesium sulphonate detergent or mixtures thereof.

A driveline device lubricating composition in different embodiments may have a composition as disclosed in the following table:

| | Embodiments (wt %) | | | |
|---|---|---|---|---|
| Additive | A | B | C | D |
| Compound of Invention | 0.05 to 0.1 | 0.05 to 0.1 | 0.05 to 0.1 | 0.05 to 0.1 |
| Dispersant | 1 to 4 | 2 to 7 | 0 to 5 | 1 to 6 |

-continued

| Additive | Embodiments (wt %) A | B | C | D |
|---|---|---|---|---|
| Extreme Pressure Agent | 3 to 6 | 0 to 6 | 0 to 3 | 0 to 6 |
| Overbased Detergent | 0 to 1 | 0.01 to 2 | 0.5 to 6 | 0.01 to 2 |
| Antioxidant | 0 to 5 | 0.01 to 2 | 0 to 3 | 0 to 2 |
| Antiwear Agent | 0.5 to 5 | 0.01 to 3 | 0.5 to 3 | 0.01 to 3 |
| Friction Modifier | 0 to 5 | 0.01 to 5 | 0.1 to 1.5 | 0 to 5 |
| Viscosity Modifier | 0.1 to 70 | 0.1 to 15 | 1 to 60 | 0.1 to 70 |
| Any Other Performance Additive | 0 to 10 | 0 to 8 | 0 to 6 | 0 to 10 |
| Oil of Lubricating Viscosity | Balance to 100% | Balance to 100% | Balance to 100% | Balance to 100% |

Footnote:
The viscosity modifier in the table abive may also be considered as an alternative to an oil of lubricating viscosity.
Column A may be representative of an automotive or axle gear lubricant.
Column B may be representative of an automatic transmission lubricant.
Column C may be representative of an off-highway lubricant.
Column D may be representative of a manual transmission lubricant.

The following examples provide illustrations of the invention. These examples are non-exhaustive and are not intended to limit the scope of the invention.

Examples

Preparative Example 1 (EX 1) is a bis (or 1:2) salt of tartaric acid with 2-ethylhexylamine. A 250 mL round bottom flask is fitted with a magnetic stirrer and a nitrogen inlet providing a nitrogen flow of 200 $cm^3$/min. This flask is charged with 2-ethylhexylamine (32.19 g). Tartaric acid (10 g) is dissolved separately in a 1:1 mixture of ethanol and water (50 mL) which is then added dropwise under ambient conditions to the stirring amine. A milky two-phase mixture is formed and stirring is continued for 28 hours. Stirring of the reaction mixture is then stopped and the mixture is allowed to settle into two phases, an aqueous phase and an oleaginous product layer. The resulting product is a colorless semi-solid, and 40.2 g are produced (TAN 137 mg KOH/g; TBN 137 mg KOH/g).

Preparative Example 2 (EX 2) is a bis salt of tartaric acid and tetrabutylammonium cation. A 1 liter flange flask is fitted with PTFE gasket, flange lid, nitrogen inlet 200 $cm^3$/min, thermocouple, overhead stirrer with PTFE gland and Dean-Stark trap fitted with double wall water cooled condenser. Tetrabutyl ammonium hydroxide (700 ml, 1M in MeOH) is charged to the vessel and warmed to 40° C., DL-tartaric acid (52.53 g) is added over 1 hour, and the reaction mixture is warmed to 120° C. Toluene is added slowly at 120° C. and stirred for 6 hours. The flask is equipped for vacuum distillation and vacuum is gradually applied to 7 kPa pressure (or 28 Inches Hg vacuum) at 140° C. and held for 2 hours; the reaction mixture is then cooled to room temperature. The product separated into the desired product as a viscous brown oil (134.27 g) (TAN 7 mg KOH/g; TBN 124 mg KOH/g).

Preparative Example 3 (EX 3) is a mono (or 1:1) salt of tartaric acid and tri-n-butylamine. A 250 mL tornado flask is fitted with a screw lid, overhead stirrer, thermocouple, nitrogen inlet port and water-cooled condenser and placed under a flow of nitrogen. Toluene (50 mL), tri-n-butylamine (0.22 mol) and tartaric acid (0.22 mol) are charged to the flask under nitrogen and heated to 65° C. for 6 hours. The reaction mixture is then heated to 100° C. for 6 hours, followed by the addition of a small amount of a polyalkylene succinate surfactant. Removal of the solvent on a rotary evaporator (at 100° C.) resulted in a light golden brown solid (TAN 310 mg KOGH/g; TBN 160 mg KOH/g).

The following 4 examples are carried out in a similar fashion as Example 3 above:

Preparative Example 4 (EX 4) is a mono salt of citric acid and tri-n-butylamine. The product is isolated as a viscous brown oil (TAN 293 mg KOH/g; TBN 153 mg KOH/g).

Preparative Example 5 (EX 5) is a bis salt of citric acid and tri-n-butylamine. The product is isolated as a dark orange viscous liquid (TAN 322 mg KOH/g; TBN 161 mg KOH/g)

Preparative Example 6 (EX 6) is a mono salt of lactic acid and tri-n-butylamine. The product is isolated as a dark red viscous liquid (TAN 180 mg KOH/g; TBN 170 mg KOH/g).

Preparative Example 7 (EX 7) is a mono salt of glycolic acid and tri-n-butylamine. The product is isolated as an orange viscous liquid (TAN 256 mg KOH/g; TBN 156 mg KOH/g).

Preparative Example 8 (EX 8) is a bis (1:2) salt of malic acid and tetra-n-butyl ammonium cation. A 1 liter flask is fitted with a flange lid and clip, PTFE stirrer gland, rod and overhead stirrer, thermocouple, nitrogen inlet port and water-cooled condenser. The flask is charged with a solution of tetra-n-butylammonium hydroxide in methanol (150 mL of 1 molar solution), placed under a flow of nitrogen. To the flask, malic acid is added (5.87 g) and the mixture heated to 65-75° C. for approximately 6 hours. Toluene is added to the mixture (110 mL) and the mixture is heated to 110° C. to remove water. The mixture is then vacuum stripped at 110° C. for 3 hours. The product is isolated as a tacky yellow solid (TAN 6 mg KOH/g; TBN 161 mg KOH/g)

The following example is carried out in a similar fashion as Example 8 above:

Preparative Example 9 (EX 9) is a mono (1:1) salt of lactic acid and tetra-n-butyl ammonium cation. The product is isolated as a tacky white solid (TAN 0; TBN 128 mg KOH/g)

Preparative Example 10 (EX 10) is a bis (1:2) salt of citric acid and 2-ethylhexylamine. A 500 mL flask is fitted with a flange lid and clip, PTFE stirrer gland, rod and overhead stirrer, thermocouple, nitrogen inlet port and water-cooled condenser. The flask is charged with citric acid (28.8 g) under nitrogen blanket. 2-ethylhexylamine (36.2 g) is added; the mixture is stirred for 2 hours. A colorless oily liquid is obtained (TAN 401 mg KOH/g; TBN 129 mg KOH/g).

Preparative Example 11 (EX 11) is a salt of malic acid and N-oleylpropylenediamine. A 500 mL flask is fitted with a flange lid and clip, PTFE stirrer gland, rod and overhead stirrer, thermocouple, nitrogen inlet port and water-cooled condenser. Malic acid (20.11 is charged to the flask under nitrogen. The amine (48.3 g) is added in one portion at ambient temperature and an exotherm is observed (38° C.). After stirring for 2 hours a tacky tan-colored semi-soled is obtained (TAN 194 mg KOH/g; TBN 221 mg KOH/g).

A series of SAE 5W-30 engine lubricants are prepared containing antioxidants (mixture hindered phenols and alkylated diphenylamines), 0.5 wt % of zinc dialkyldithiophosphate, a mixture of detergents (including calcium sulfonate and sodium sulfonate), a succinimide dispersant, and further containing 0.05 wt % or 0.10 wt % of a product from EX1 to EX11.

Comparative Example 1 (CE1) is a SAE 5W-30 lubricant the same as those described above, except it does not contain a product of example EX1 to EX11. Instead, it contains a 2-ethylhexyl ester of tartaric acid (2-EHT) made from the condensation of tartaric acid and 2-ethylhexanol (as described in U.S. Pat. No. 7,651,987), in an amount 0.5 wt % of the overall composition.

Test 1: Wear and Friction Performance on High Frequency Reciprocating RIG (HFRR)

The SAE 5W-30 lubricants are evaluated for boundary lubrication friction performance and wear in a programmed temperature high frequency reciprocating rig (HFRR) available from PCS Instruments. HFRR conditions for the evaluations are 500 g load, 75 minute duration, 1000 micrometer stroke, 20 Hertz frequency, and temperature profile of 15 minutes at 40° C. followed by an increase in temperature to 160° C. at a rate of 2° C. per minute. The upper test piece is a 6 mm diameter steel ball (ANSI E-52100, Rockwell 'C' hardness 58-66 and a surface finish of Ra<0.05 μm), the lower test specimen is either a flat steel disc (ANSI E-52100, Vickers "HV30" hardness 190-210 and a surface finish of Ra<0.02 μm) or an aluminium specimen of similar size. Both the upper and lower specimens are available together from PCS Instruments (Part Number HFRSSP). The coefficient of friction, wear and contact potential are then measured. The coefficient of friction is calculated by dividing the measured friction force parallel to the direction of reciprocation by the load applied. The contact potential is measured by applying a small electrical potential between the upper and lower test specimens. If the instrument measures the full electrical potential applied, this is indicative of an electrically insulating layer between the upper and lower test specimens, this is usually interpreted as the formation of a chemical protective film on the surfaces. If no protective film is formed there is metal to metal contact between the upper and lower test specimens and the measured electrical potential drops to zero. Intermediate values are indicative of partial or incomplete protective films. The contact potential is often presented as a percentage of the applied electrical potential and called percent film thickness. The wear, coefficient of friction and contact potential results obtained are presented in the following table.

| 5W-30 Lubricant Example | Product of Example | Treat Rate of Additive | Wear Scar (μm) | CoF |
|---|---|---|---|---|
| Baseline | — | 0 | 211 | 0.136 |
| CE1 | 2-EHT | 0.5 | 188 | 0.127 |
| L1 | EX1 | 0.05 | 169 | 0.133 |
| L2 | EX2 | 0.05 | 195 | 0.125 |
| L3 | EX2 | 0.10 | 183 | 0.128 |

The wear scar results and coefficient of friction (CoF) shown above for Fe (iron) surfaces are the average of two experiments per sample.

Overall the data presented indicates that the lubricating composition of the invention (for example, an internal combustion engine lubricant) containing a compound of the invention provides one or more of antiwear performance or friction reduction (particularly for enhancing fuel economy) in comparison to a lubricant without said additive. More importantly, the additive of the invention, when used at a significantly reduced treat level relative to previously published hydroxyl-acid derivatives (e.g. tartaric acid esters), provides an equivalent or improved performance.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to [0141] of published application US 2010-0197536.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity and 0.1 wt % to 0.5 wt % a non-metallic cationic pnictogen salt of a hydroxy-carboxylic acid, or mixtures thereof, wherein the non-metallic cationic pnictogen salt of a hydroxy-carboxylic acid is a quaternary ammonium salt of a hydroxy-carboxylic acid, wherein the quaternary ammonium salt is derived from an amine comprising alkyl groups having 3 to 10 carbon atoms, and wherein the hydroxy-carboxylic acid is selected from the group consisting of glycolic acid, tartaric acid and mixtures thereof.

2. The lubricating composition of claim 1, wherein lubricating composition contains 0.05 wt % to 0.1 wt % of the non-metallic cationic pnictogen salt of a hydroxy-carboxylic acid, or mixtures thereof.

3. The lubricating composition of claim 1 further comprising a zinc dialkyldithiophosphate.

4. The lubricating composition of claim 1 further comprising an overbased detergent, wherein the overbased detergent is typically selected from the group consisting of phenates, sulphur containing phenates, sulphonates, salixarates, salicylates, and mixtures thereof.

5. The lubricating composition of claim 1, wherein the lubricating composition is characterised as having (i) a sulphur content of 0.5 wt % or less, (ii) a phosphorus content of 0.1 wt % or less, and (iii) a sulphated ash content of 1.5 wt % or less.

6. A method of lubricating an internal combustion engine comprising supplying to the internal combustion engine a lubricating composition of claim 1.

7. The method of claim 6, wherein the internal combustion engine has an aluminium alloy, an aluminium composite or iron-containing surface on a cylinder bore, cylinder block, or piston ring.

8. The method of claim 6, wherein the internal combustion engine has a steel surface on a cylinder bore, cylinder block, or piston ring.

9. The method of claim 6, wherein the internal combustion engine has a surface of steel, or an aluminium alloy, or an aluminium composite.

10. A method of lubricating a driveline device comprising supplying to the driveline device a lubricating composition of claim 1.

11. The method of claim 10, wherein the driveline device includes a manual transmission that may or may not contain a synchronizer system, or an automatic transmission, or an axle.

12. The method of any claim 10, wherein the lubricating composition has a sulphur-content of greater than 0.5 wt % to 3 wt % of the lubricating composition.

13. The method of any claim 10, wherein the lubricating composition has a phosphorus content of 450 ppm to 4000 ppm.

14. The lubricating composition of claim 1, wherein the quaternary ammonium salt is derived from a tetraalkylammonium hydroxide comprising alkyl groups having 1 to 30 carbon atoms.

15. The lubricating composition of claim 14, wherein the quaternary ammonium salt is derived from a tetraalkylammonium hydroxide comprising alkyl groups consisting of alkyl groups having 1 to 8 carbon atoms.

16. The lubricating composition of claim 15, wherein at least one alkyl group is a branched alkyl group.

17. The lubricating composition of claim 14, wherein the quaternary ammonium salt is derived from a tetraalkylammonium hydroxide comprising alkyl groups consisting of linear alkyl groups.

* * * * *